US009806418B2

(12) United States Patent
Lin

(10) Patent No.: US 9,806,418 B2
(45) Date of Patent: Oct. 31, 2017

(54) ANTENNA STRUCTURE FOR ELECTRONIC DEVICE

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 6 days.

(21) Appl. No.: 14/923,631

(22) Filed: Oct. 27, 2015

(65) Prior Publication Data

US 2016/0218421 A1 Jul. 28, 2016

(30) Foreign Application Priority Data

Jan. 23, 2015 (TW) ..... 104102225 A

(51) Int. Cl.

| | |
|---|---|
| ***H01Q 1/50*** | (2006.01) |
| ***H01Q 9/36*** | (2006.01) |
| ***H01Q 5/378*** | (2015.01) |
| ***H01Q 5/328*** | (2015.01) |
| ***H01Q 1/38*** | (2006.01) |
| ***H01Q 5/371*** | (2015.01) |
| ***H01Q 1/24*** | (2006.01) |

(52) U.S. Cl.
CPC ..... *H01Q 5/371* (2015.01); *H01Q 1/243* (2013.01); *H01Q 1/38* (2013.01); *H01Q 1/50* (2013.01); *H01Q 5/328* (2015.01); *H01Q 5/378* (2015.01); *H01Q 9/36* (2013.01)

(58) Field of Classification Search
None
See application file for complete search history.

(56) References Cited

U.S. PATENT DOCUMENTS

2014/0354508 A1* 12/2014 Lee ..... H01Q 1/48 343/860
2014/0361948 A1* 12/2014 Tanaka ..... H01Q 1/38 343/861

* cited by examiner

*Primary Examiner* — Robert Karacsony
(74) *Attorney, Agent, or Firm* — Steven Reiss

(57) ABSTRACT

An antenna structure for an electronic device includes a first portion, a number of radiating sections, and a number of branch sections. The first portion receives an electric current from a printed circuit board of the electronic device and couples the electric current to the number of radiating sections and the number of branch sections of the antenna structure.

21 Claims, 5 Drawing Sheets

ANTENNA STRUCTURE FOR ELECTRONIC DEVICE

FIELD

The present disclosure relates to antenna structures of an electronic device, and more particularly to an antenna structure capable of effectively operating at low-band and high-band frequencies.

BACKGROUND

Generally, antennas of electronic devices, such as mobile phones, can operate at low-band and high-band frequencies. It is important for the antennas to achieve a broad range of transmission frequencies while operating within a limited space.

BRIEF DESCRIPTION OF THE DRAWINGS

Implementations of the present technology will now be described, by way of example only, with reference to the attached figures.

DETAILED DESCRIPTION

Figure 1:
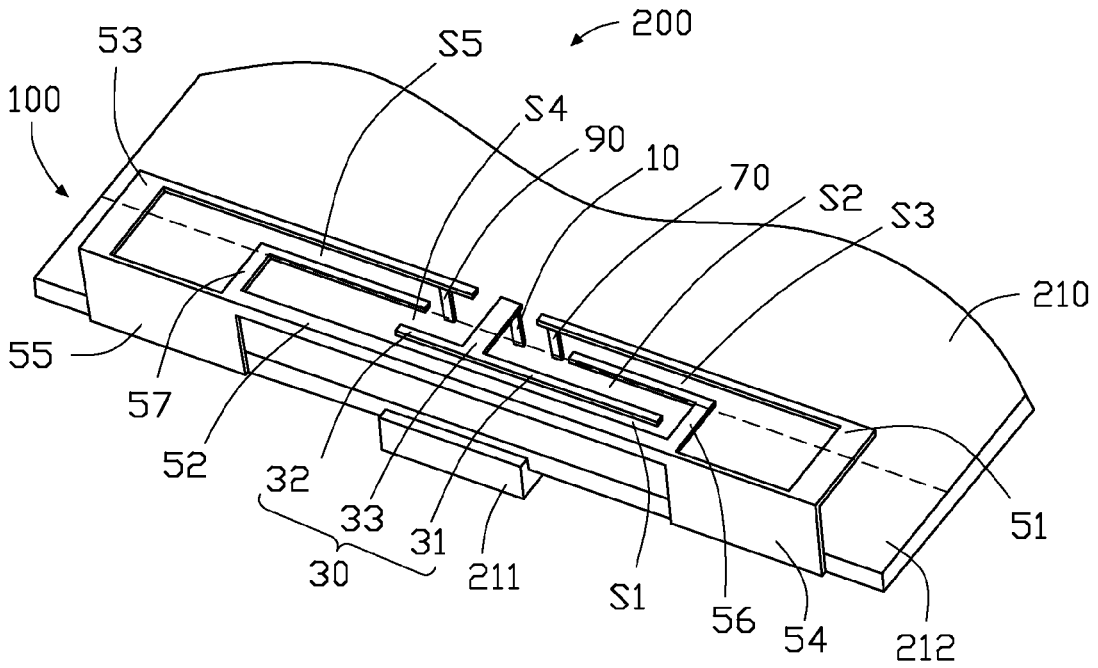
FIG. 1 is an isometric view of a first embodiment of an antenna structure of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
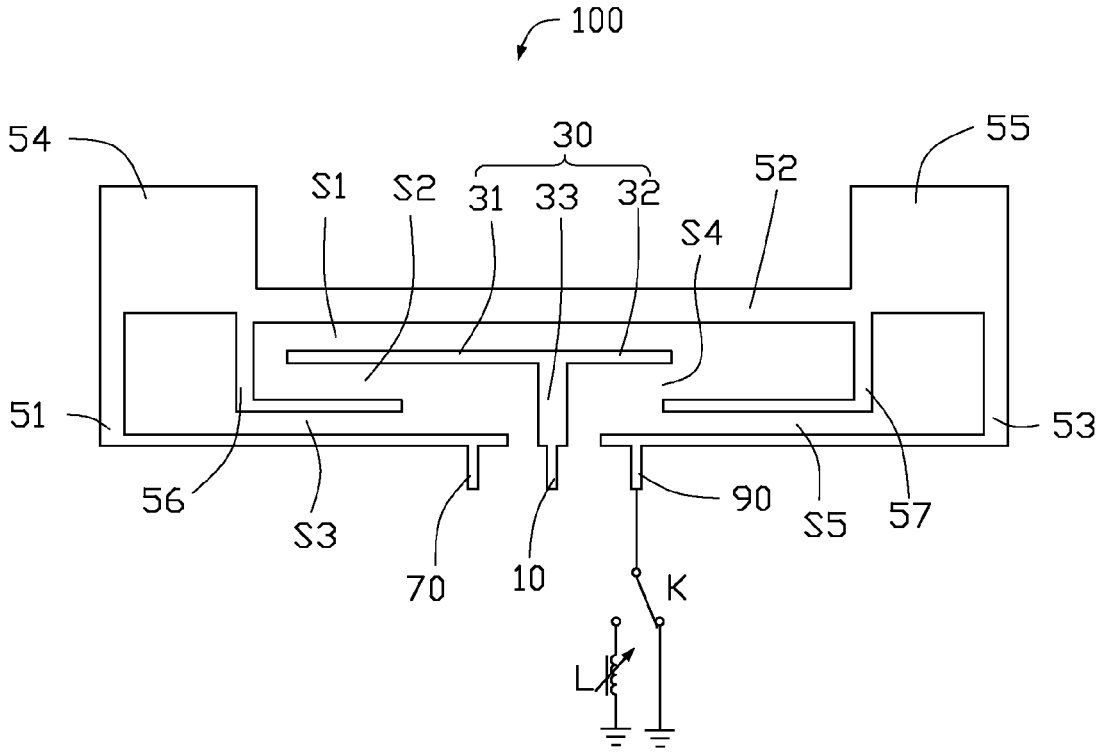
FIG. 2 is a flat plan view of the antenna structure of FIG. 1 showing a circuit configuration of the antenna structure.

FIG. 1 and FIG. 2 illustrate an embodiment of an antenna structure 100 implemented in a wireless electronic device 200. In at least one embodiment, the electronic device 200 can be a mobile phone having size dimensions of 64×130×11 millimeters. The antenna structure 100 can operate at low-band and high-band frequencies.

The antenna structure 100 can include a first portion 10, a second portion 70, a third portion 90, a first radiating section 30, a second radiating section 51, a third radiating section 53, a fourth radiating section 52, a fifth radiating section 54, a sixth radiating section 55, a first branch section 56, and a second branch section 57. The first portion 10 can be electrically coupled to the printed circuit board 210 and receive an electric current from a printed circuit board 210 of the electronic device 200. The second portion 70 and the third portion 90 can be electrically coupled to the printed circuit board 210. In at least one embodiment, the second portion 70 is configured to electrically couple to ground, and the third portion 90 is configured to selectively couple to ground in one of at least two configurations. In at least one embodiment, the third portion 90 can selectively electrically couple to ground or to ground through a variable inductor L. The third portion 90 can include a switch K to electrically couple the antenna structure 100 to ground directly or to ground through the variable inductor L. In at least one embodiment, an inductance value of the variable inductor L can be about 10 nanohenries.

The first portion 10, the second portion 70, and the third portion 90 can be arranged in a first plane. The first radiating section 30, the second radiating section 51, the third radiating section 53, the first branch section 56, and the second branch section 57 can be arranged in a second plane. The fourth radiating section 52 can be arranged in the second plane and a third plane. The fifth radiating section 54 and the sixth radiating section 55 can be arranged in the third plane. In at least one embodiment, the second plane is substantially parallel to the printed circuit board 210 and substantially perpendicular to the first plane and the third plane. A clearance space 212 can be defined between an end portion of the printed circuit board 210 and the second plane. The clearance space has no electrical conducting elements therein to prevent electrical interference with the antenna structure 100.

The fourth radiating section 52 can include a first border strip (not labeled) and a second border strip (not labeled) joined together at a junction of the second plane and the third plane. The first border strip can be arranged in the second plane and electrically coupled to the first branch section 56 and the second branch section 57. The second border strip can be arranged in the third plane and electrically coupled to the fifth radiating section 54 and the sixth radiating section 55.

The second radiating section 51, the third radiating section 53, the first branch section 56, and the second branch section 57 can be substantially L-shaped. The second radiating section 51, the fifth radiating section 54, the fourth radiating section 52, the sixth radiating section 55, and the third radiating section 53 connects in that order and corporately form a loop antenna structure, with an opening defined between the second radiating section 51 and the third radiating section 53. The loop antenna structure surrounds the first radiating section 30.

The first radiating section 30 can be substantially T-shaped, planar, and parallel to the printed circuit board 210. The first radiating section 30 can include a main strip 33, a first coupling strip 31, and a second coupling strip 32. The main strip 33 can be coupled to the first portion 10 to receive the electric current. The first coupling strip 31 can extend from one side of the main strip 33, and the second coupling strip 32 can extend from another side of the main strip 33.

The first branch section 56 can receive a coupling electric current from the first radiating section 30. The first branch section 56 can include a first connecting strip (not labeled) and a first extending strip (not labeled). The first connecting strip can extend from the first border strip and be spaced from the first coupling strip 31 of the first radiating section 30. The first extending strip can extend from the first connecting strip and extend toward the main strip 33 of the first radiating section 30.

The second branch section 57 can receive the coupling electric current from the first radiating section 30. The second branch section 57 can include a second connecting strip (not labeled) and a second extending strip (not labeled). The second connecting strip can extend from the first border strip and be spaced from the second coupling strip 32 of the first radiating section 30. The second extending strip can extend from the second connecting strip and extend toward the main strip 33 of the first radiating section 30.

The second radiating section 51 can receive the coupling electric current from the first branch section 56. The second radiating section 51 can include a third connecting strip (not labeled) and a third extending strip (not labeled). The third connecting strip can extend from the fifth radiating section 54 at the junction of the second plane and the third plane and be spaced from the first connecting strip. The third extending strip extends from the third connecting strip and extends toward the main strip 33 of the first radiating section 30. The second portion 70 can extend from the third extending strip.

The third radiating section 53 can receive the coupling electric current from the second branch section 57. The third radiating section 53 can include a fourth connecting strip (not labeled) and a fourth extending strip (not labeled). The fourth connecting strip can extend from the sixth radiating section 55 at the junction of the second plane and the third plane and be spaced from the second connecting strip. The fourth extending strip extends from the fourth connecting strip and extends toward the main strip 33 of the first radiating section 30. The third portion 90 can extend from the fourth extending strip.

The fifth radiating section 54 can be connected to the second border strip and the third connecting strip at the junction between the second plane and the third plane. The sixth radiating section 55 can be connected to the second border strip and the fourth connecting strip at the junction between the second plane and the third plane.

A first gap S1 is defined between the first border strip of the fourth radiating section 52 and the first and second coupling strips 31, 32 of the first radiating section 30. A second gap S2 is defined between the first coupling strip 31 and the first extending strip. A third gap S3 is defined between the first extending strip and the third extending strip. A fourth gap S4 is defined between the second coupling strip 32 and the second extending strip. A fifth gap S5 is defined between the second extending strip and the fourth extending strip. The fourth radiating section 52 can receive the coupling electric current from the first radiating section 30 across the first gap S1. The first branch section 56 can receive the coupling electric current from the first radiating section 30 across the second gap S2. The second radiating section 51 can receive the coupling electric current from the first branch section 56 across the third gap S3. The second branch section 57 can receive the coupling electric current from the first radiating section 30 across the fourth gap S4. The third radiating section 53 can receive the coupling electric current from the second branch section 57 across the fifth gap S5.

A clearance space 212 can be defined between an end portion of the printed circuit board 210 and the second plane. The clearance space 212 has no electrical conducting elements received therein. A connecting port 211 can be electrically coupled to the printed circuit board 210 and located at the end portion of the printed circuit board 210 corresponding to the clearance space 212. The connecting port 211 can electrically couple to an external electronic device (not shown). In at least one embodiment, the connecting port 211 is a universal serial bus (USB) port.

Figure 3:
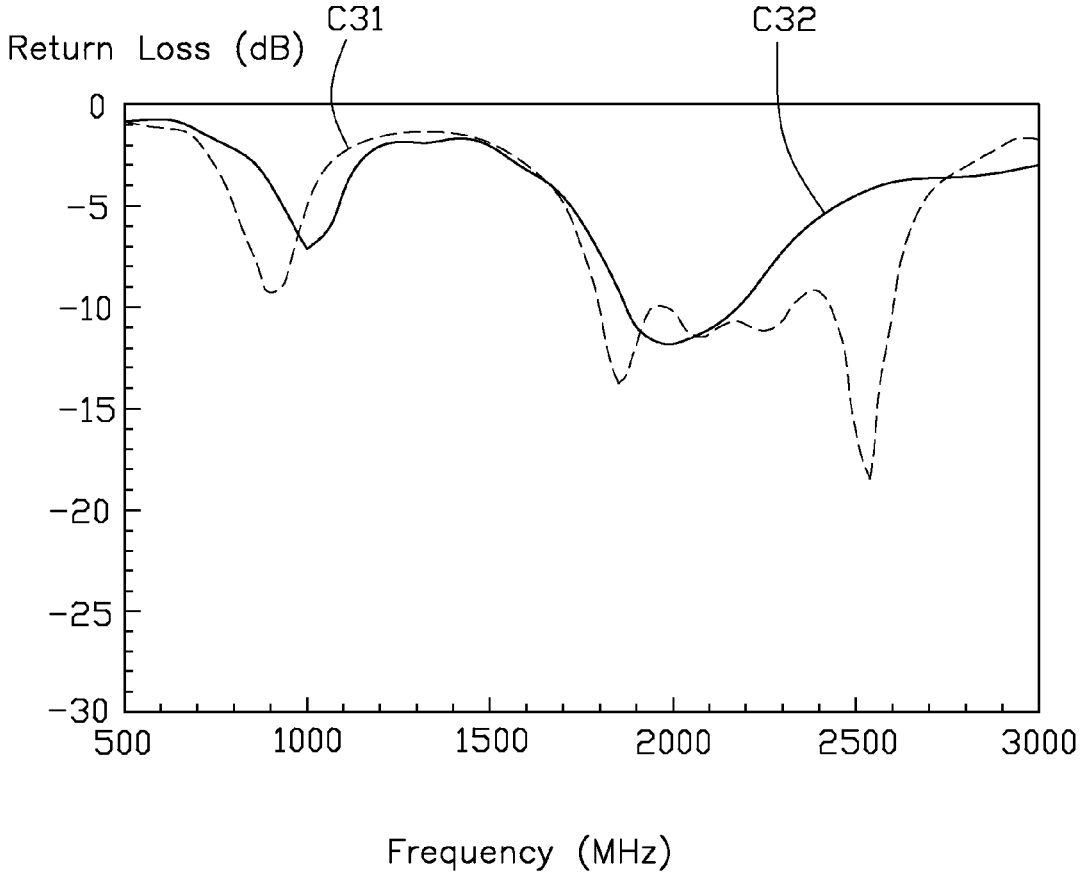
FIG. 3 is a return loss diagram comparing the antenna structure of the present disclosure to another antenna structure.

FIG. 3 illustrates a return loss diagram of the antenna structure 100 when the switch K of the third portion 90 electrically couples to ground directly. The return loss diagram compares a return loss curve C31 of the antenna structure 100 including the first and second branch sections 56, 57 and a return loss curve C32 of the antenna structure 100 not including the first and second branch sections 56, 57. As illustrated in FIG. 3, when the antenna structure 100 includes the first and second branch sections 56, 57, a low-band frequency range and a high-band frequency range of the antenna structure 100 is improved. The antenna structure 100 can operate at low-band frequencies between about 824 megahertz (MHz) and about 960 MHz, and operate at high-band frequencies between about 1710 MHz and about 2690 MHz.

Figure 4:
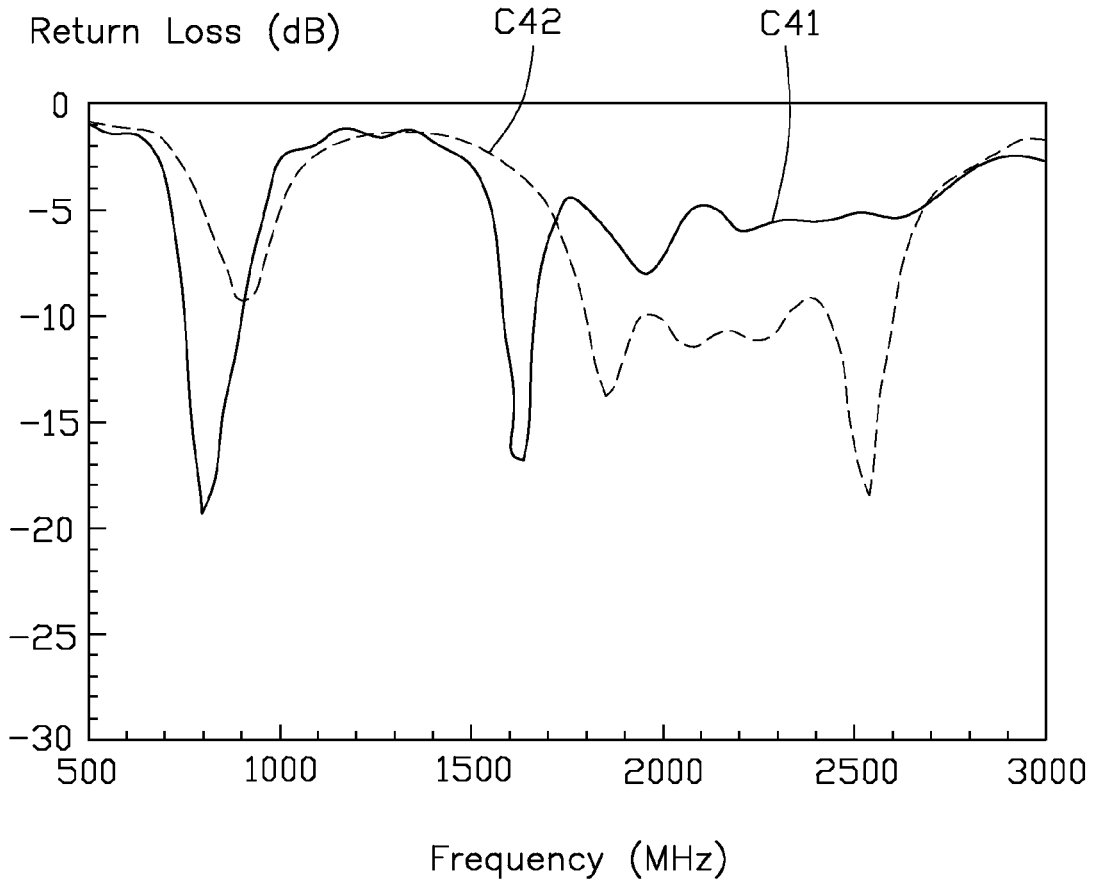
FIG. 4 is a return loss diagram comparing two states of the antenna structure of the present disclosure.

FIG. 4 illustrates a return loss diagram of the antenna structure 100 including the first and second branch sections 56, 57 comparing a return loss curve C42 when the switch K of the third portion 90 electrically couples to ground directly and a return loss curve C41 when the switch K of the third portion 90 electrically couples to ground through the variable inductor L. As illustrated in FIG. 4, the return loss curve C42 is substantially the same as the return loss curve C31 of FIG. 3. By adjusting the inductance value of the variable inductor L to 10 nH, the low-band frequency range of the antenna structure 100 can be increased. In other embodiments, the inductance value of the inductor L can be changed to change the low-band frequency range of the antenna structure 100.

Figure 5:
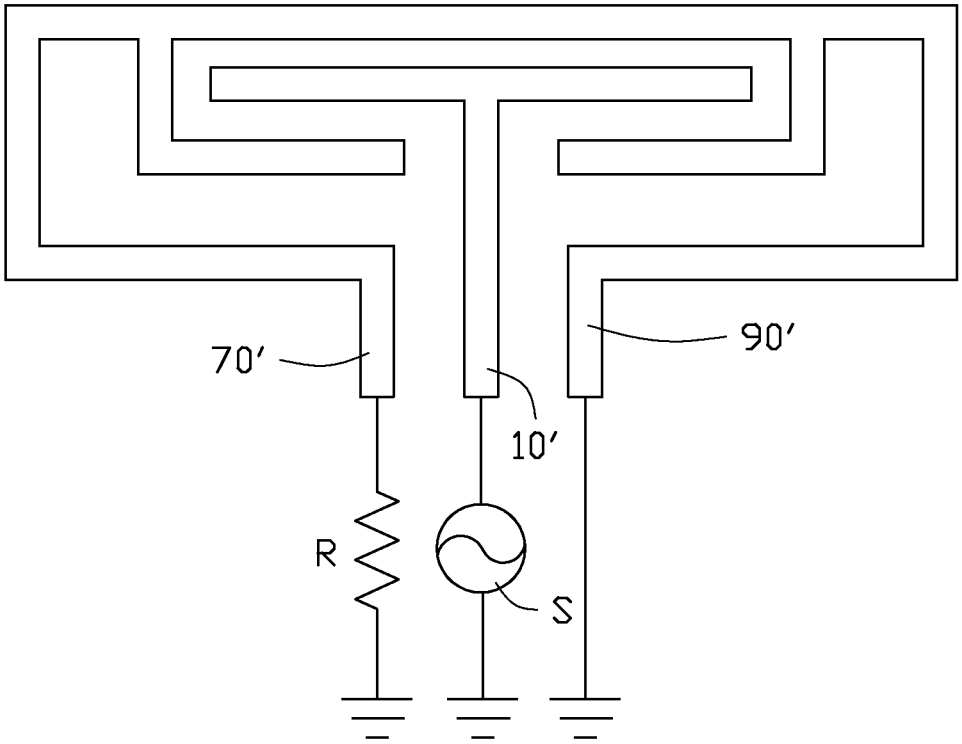
FIG. 5 is a flat plan diagram of a second embodiment of an antenna structure of an electronic device showing a circuit configuration of the antenna structure.

FIG. 5 illustrates a second embodiment of the antenna structure 100. The second embodiment can be substantially similar to the first embodiment, except that the second embodiment includes a first portion 10', a second portion 70', and a third portion 90'. The first portion 10' can receive an electric current from a current feeding terminal S. The second portion 70' can electrically couple to ground through a resistor R. The third portion 90' can electrically couple to ground directly. By switching on and off connections of the first portion 10', the second portion 70', and the third portion 90' to the current feeding terminal S, ground, and the resistor R, respectively, the antenna structure 100 can operate at different bandwidths.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure for an electronic device having a printed circuit board, comprising:

a first portion configured to be electrically coupled to the printed circuit board;

a second portion configured to be electrically coupled to the printed circuit board;

a third portion configured to be electrically coupled to the printed circuit board, wherein one of the first portion, the second portion, and the third portion is configured to receive an electric current from the printed circuit board;

a first radiating section electrically coupled to the first portion;

a second radiating section electrically coupled to the second portion;

a third radiating section electrically coupled to the third portion;

a fourth radiating section electrically coupled between the second radiating section and the third radiating section;

a first branch section electrically coupled to the fourth radiating section and configured to receive a coupling electric current from the first radiating section; and a second branch section electrically coupled to the fourth radiating section and configured to receive the coupling electric current from the first radiating section;

wherein the second radiating section, the third radiating section and the fourth radiating section form a loop structure surrounding the first radiating section;

wherein the first portion is configured to receive the electric current from the printed circuit board, the second portion is configured to be coupled to ground, and the third portion is configured to be selectively coupled to ground in one of at least two different configurations;

wherein the first radiating section is electrically coupled to the first portion to receive the electric current; the second radiating section is configured to receive the coupling electric current from the first radiating section; and the third radiating section is configured to receive the coupling electric current from the first radiating section.

2. The antenna structure as in claim 1, wherein the first radiating section is substantially T-shaped.

3. The antenna structure as in claim 1, wherein the first radiating section is positioned between the first branch section and the second branch section.

4. The antenna structure as in claim 1, wherein the third portion is configured to selectively electrically couple to ground directly or to ground through a variable inductor.

5. The antenna structure as in claim 1, further comprising:

a fifth radiating section electrically coupled to the second radiating section and the fourth radiating section; and a sixth radiating section electrically coupled to the third radiating section and the fourth radiating section.

6. The antenna structure as in claim 5, wherein:

the first portion, the second portion, and the third portion are arranged in a first plane;

the first radiating section, the second radiating section, the third radiating section, the first branch section, and the second branch section are arranged in a second plane;

the fourth radiating section is arranged in the second plane and a third plane; and the fifth radiating section and the sixth radiating section are arranged in the third plane.

7. The antenna structure as in claim 6, wherein the first radiating section comprises:

a main strip coupled to the first portion to receive the electric current;

a first coupling strip extending from one side of the main strip; and a second coupling strip extending from another side of the main strip.

8. The antenna structure as in claim 7, wherein the fourth radiating section comprises:

a first border strip arranged in the second plane and bordering a junction between the second plane and the third plane; and a second border strip arranged in the third plane and bordering a junction between the second plane and the third plane.

9. The antenna structure as in claim 8, wherein:

the first branch section comprises a first connecting strip and a first extending strip;

the first connecting strip extends from the first border strip and is spaced from the first coupling strip of the first radiating section; and the first extending strip extends from the first connecting strip and extends toward the main strip of the first radiating section.

10. The antenna structure as in claim 9, wherein:

the second branch section comprises a second connecting strip and a second extending strip;

the second connecting strip extends from the first border strip and is spaced from the second coupling strip of the first radiating section; and the second extending strip extends from the second connecting strip and extends toward the main strip of the first radiating section.

11. The antenna structure as in claim 10, wherein:

the second radiating section comprises a third connecting strip and a third extending strip;

the third connecting strip extends from the fifth radiating section at the junction of the second plane and the third plane and is spaced from the first connecting strip; and the third extending strip extends from the third connecting strip and extends toward the main strip of the first radiating section.

12. The antenna structure as in claim 11, wherein the second portion extends from the third extending strip.

13. The antenna structure as in claim 11, wherein:

the third radiating section comprises a fourth connecting strip and a fourth extending strip;

the fourth connecting strip extends from the sixth radiating section at the junction of the second plane and the third plane and is spaced from the second connecting strip; and the fourth extending strip extends from the fourth connecting strip and extends toward the main strip of the first radiating section.

14. The antenna structure as in claim 13, wherein the fifth radiating section is connected to the second border strip and the third connecting strip at the junction between the second plane and the third plane, and the sixth radiating section is connected to the second border strip and the fourth connecting strip at the junction between the second plane and the third plane.

15. The antenna structure as in claim 14, wherein:

a first gap is defined between the first border strip of the fourth radiating section and the first and second coupling strips of the first radiating section;

a second gap is defined between the first coupling strip and the first extending strip;

a third gap is defined between the first extending strip and the third extending strip;

a fourth gap is defined between the second coupling strip and the second extending strip;

a fifth gap is defined between the second extending strip and the fourth extending strip;

the fourth radiating section receives the coupling electric current from the first radiating section across the first gap;

the first branch section receives the coupling electric current from the first radiating section across the second gap;

the second radiating section receives the coupling electric current from the first branch section across the third gap;

the second branch section receives the coupling electric current from the first radiating section across the fourth gap; and the third radiating section receives the coupling electric current from the second branch section across the fifth gap.

16. The antenna structure as in claim 15, wherein:

a clearance space is defined between an end portion of the printed circuit board and the second plane;

the clearance space has no electrical conducting elements received therein;

a connecting port is electrically coupled to the printed circuit board and located at the end portion of the printed circuit board corresponding to the clearance space, the connecting port configured to electrically couple to an external electronic device.

17. The antenna structure as in claim 1, wherein the second portion is configured to be electrically coupled to ground through a resistor, and the third portion is configured to be electrically coupled to ground directly.

18. An electronic device comprising:

a printed circuit board; and an antenna structure, comprising:

a first portion configured to be electrically coupled to the printed circuit board;

a second portion configured to be electrically coupled to the printed circuit board;

a third portion configured to be electrically coupled to the printed circuit board, wherein one of the first portion, the second portion, and the third portion is configured to receive an electric current from the printed circuit board;

a first radiating section electrically coupled to the first portion;

a second radiating section electrically coupled to the second portion;

a third radiating section electrically coupled to the third portion;

a fourth radiating section electrically coupled between the second radiating section and the third radiating section;

a first branch section electrically coupled to the fourth radiating section and configured to receive a coupling electric current from the first radiating section; and a second branch section electrically coupled to the fourth radiating section and configured to receive the coupling electric current from the first radiating section;

wherein the second radiating section, the third radiating section and the fourth radiating section form a loop structure surrounding the first radiating section;

wherein the first portion is configured to receive the electric current from the printed circuit board, the second portion is configured to be coupled to ground, and the third portion is configured to be selectively coupled to ground in one of at least two different configurations;

wherein the first radiating section is electrically coupled to the first portion to receive the electric current; the second radiating section is configured to receive the coupling electric current from the first radiating section; and the third radiating section is configured to receive the coupling electric current from the first radiating section.

19. The electronic device as in claim 18, wherein the first radiating section is substantially T-shaped and is positioned between the first branch section and the second branch section.

20. The electronic device as in claim 18, wherein the antenna structure further comprises:

a fifth radiating section electrically coupled to the second radiating section and the fourth radiating section; and a sixth radiating section electrically coupled to the third radiating section and the fourth radiating section.

21. The electronic device as in claim 20, wherein:

the first portion, the second portion, and the third portion are arranged in a first plane;

the first radiating section, the second radiating section, the third radiating section, the first branch section, and the second branch section are arranged in a second plane;

the fourth radiating section is arranged in the second plane and a third plane; and the fifth radiating section and the sixth radiating section are arranged in the third plane.

* * * * *